United States Patent [19]

Bliss

[11] 4,434,594

[45] Mar. 6, 1984

[54] WINDOW FRAME OR DOOR FRAME SECTION

[75] Inventor: Robert H. Bliss, Monroe, La.

[73] Assignee: Bliss Steel Products Corp., East Syracuse, N.Y.

[21] Appl. No.: 413,825

[22] Filed: Sep. 1, 1982

[51] Int. Cl.[3] ..... E04C 3/30; E06B 7/14

[52] U.S. Cl. ..... 52/209; 52/481; 52/729; 52/732

[58] Field of Search ..... 52/481, 729, 209, 364, 52/732, 476, 773

[56] References Cited

U.S. PATENT DOCUMENTS

| | | | |
|---|---|---|---|
| 2,633,945 | 4/1953 | Millier | 52/364 |
| 2,945,269 | 7/1960 | Domen | 52/476 |
| 3,487,601 | 1/1970 | James | 52/773 |
| 3,499,251 | 3/1970 | Sandmann et al. | 52/481 |
| 4,115,973 | 9/1978 | Anderson | 52/773 |

FOREIGN PATENT DOCUMENTS

| | | | |
|---|---|---|---|
| 1079458 | 5/1954 | France | 52/209 |
| 1200487 | 6/1959 | France | 52/209 |

*Primary Examiner*—James L. Ridgill, Jr.

*Attorney, Agent, or Firm*—Watson, Cole, Grindle & Watson

[57] ABSTRACT

A frame section for a window frame or a door frame structure includes at least one roll-formed frame member of substantially L-shape in cross-section which may be combined with other identically shaped and sized frame members to form Z- and T-shaped configurations. Each section has an open dovetail channel capable of receiving a glass molding member for supporting a window pane or door pane against an opposing abutment wall formed on each section. When sections are combined into the Z- and T-shapes, confronting lips of the sections define grooves for the reception of sealing strips, and weep hole inserts for channeling rain water and condensation from the window unit to the outside may be provided at the corner or corners of the window frames.

4 Claims, 11 Drawing Figures

20
20A
20B
21
21a
21b
22
23
24
25
26
26a
26b
27
27a
27b
28
29
29a
29b
31
32
34
35
42
43
44
45
46
46a
47
48
49
51
52
53

WINDOW FRAME OR DOOR FRAME SECTION

BACKGROUND OF THE INVENTION

This invention relates generally to a section or profile arrangement for a door frame or a window frame, and more particularly to such a section which is basically L-shaped in cross-section and is combinable with like sections to form T-shapes and Z-shapes.

Several various types of profile members or frame sections are normally required for window frame or door frame assemblies. Window openings in which fixed windows and vented windows are mounted normally required about six or more common shapes to form the window assemblies. This not only increases the cost of window fabrication, but requires the storage and stock of a large and wide variety of profile members which results in increased labor costs during fabrication and assembly of the members. Besides, the frame sections are oftentimes of complex shapes which present obvious drawbacks and additional costs during the fabrication and assembling processes.

In addition, the prior glass molding members for holding the glass panes in place, of generally U-shaped configuration, are likewise of complex shapes and have a tendency to unseat after installation with the frame section.

SUMMARY OF THE INVENTION

It is therefore an object of the present invention to provide a section member for a window or door frame which is easy to fabricate and to install, and which reduces labor costs yet is highly economical and effective in the assembly of window and door frames without the need for a wide variety of stock parts.

Another object of the present invention is to provide such frame section of cold-rolled metal having basically a substantially L-shaped configuration and being combinable with like frame sections so as to form substantially T-shaped configurations and substantially Z-shaped configurations. These combined sections are designed to define grooves which are adapted to receive sealing elements.

The L-shaped window or door frame section has a flat web portion with flanges at opposite ends thereof and extending in a common direction so as to converge toward one another at acute angles to the plane of the web. These flanges define an open dovetail shape channel which is capable of receiving a glass molding member. And wall portions extend outwardly of the free ends of these flanges and lie parallel to the web portion in spaced relation. A lip extends toward the web from the free end of one of the walls, substantially perpendicular to the web and terminates in spaced relation from an opposite side thereof. An abutment wall capable of supporting one side of a window pane extends from the free end of the other wall portion away from and substantially perpendicular to the web, and a lip extends from this abuttment wall toward and substantially perpendicular to the web and terminates in spaced relation from its opposite side.

A still further object of the present invention is to provide such combined frame sections having interconnected web portions wherein the aforementioned lips of each L-shaped section confront one another to form grooves which are capable of receiving elongated sealing strips of elastromeric material.

A still further object is to provide such a combined frame section wherein the interconnected web portions and one of the abutment walls are provided with drainage weep holes, an insert being mounted thereon and defining a channel extending between the holes.

Other objects, advantages and novel features of the invention will become more apparent from the following detailed description of the invention when taken in conjunction with the accompanying drawings.

DETAILED DESCRIPTION OF THE INVENTION

Figures 1, 2, 3, 7, 8:
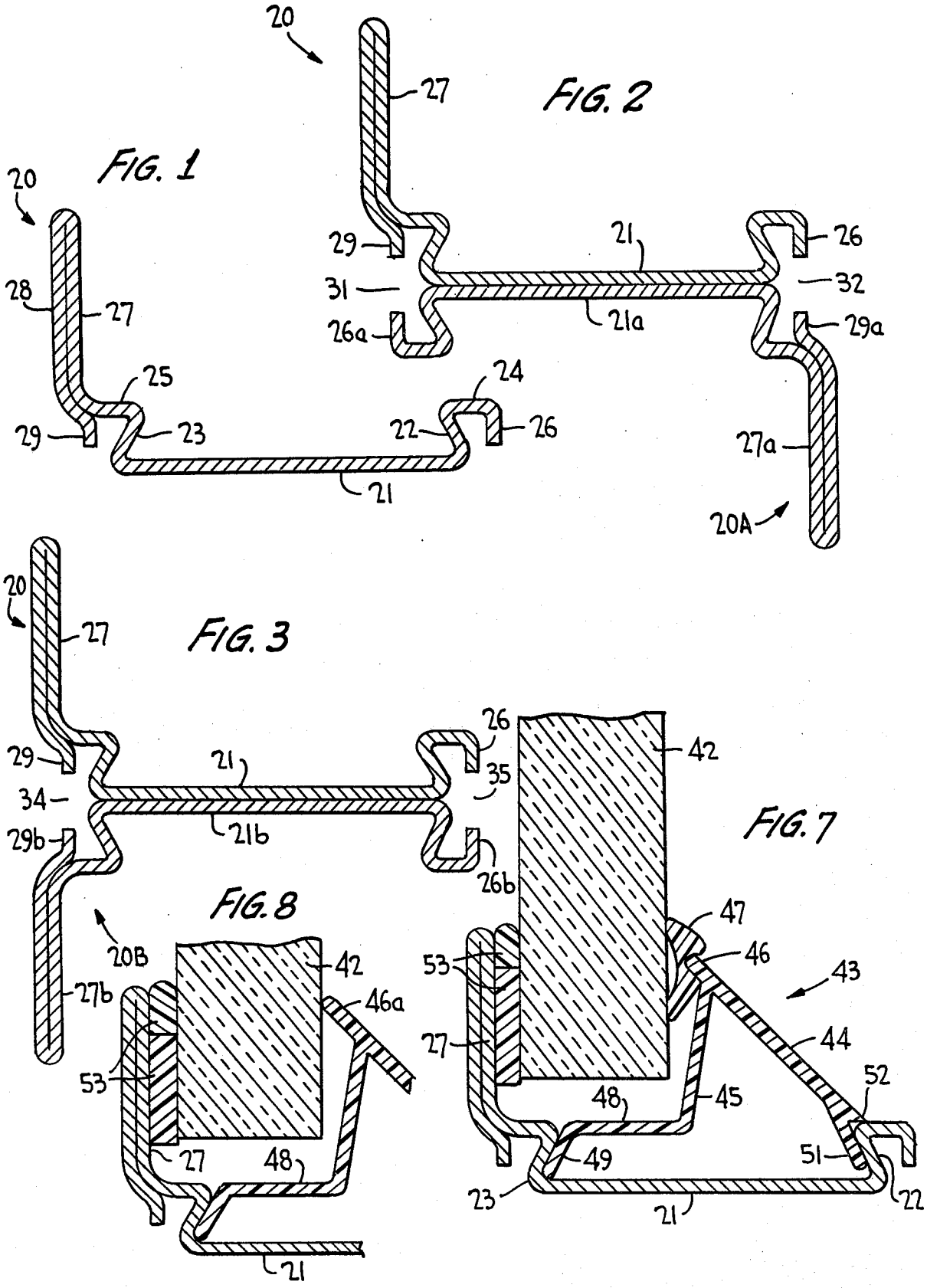
FIG. 1 is a cross-sectional view of a frame member according to the invention of the basically L-shaped configuration.
FIG. 2 is a cross-sectional view of combined frame members of FIG. 1 forming a substantially Z-shaped configuration.
FIG. 3 is a cross-sectional view of combined FIG. 1 shapes forming a substantially T-shaped configuration.
FIGS. 7 and 8 are cross-sectional view showing a glass molding member fitted on the FIG. 1 frame member for retaining a glass window pane in place using an inner, compressible seal in FIG. 7.

Turning now to the drawings wherein like reference characters refer to like and corresponding parts throughout the several views, the basic frame section of the invention, generally designated 20, is formed by cold rolling into a substantially L-shaped configuration which includes a flat web portion 21 having bends at opposite ends forming first and second flanges 22 and 23 extending from a common side of the web and extending toward one another at acute angles to the plane of the web, the flanges forming an open dovetail shape channel. End wall portions 24 and 25, integral with the flanges, extend outwardly of the free ends thereof in parallel relation to the web and lie in a common plane offset from the web portion. A lip 26 is integrally formed with end wall portion 24 and extends from a free end thereof toward web portion 21 in perpendicular relation to and terminates in spaced relation from that side of the web lying opposite the side from which flanges 22 and 23 extend. An abutment wall 27 is integrally formed with wall portion 25 and extends from a free end thereof, forming a smooth bend, away from web portion 21 and perpendicularly thereto, the abutment wall being reversely bent so as to define an overlying portion 28 which terminates in a lip 29 extending toward and perpendicular to the web portion. This lip 29, as similarly described for lip 26, terminates at a short distance from the opposite side of the web portion.

A like profile member 20A of identical size and configuration to member 20 is combinable therewith into a profile member of substantially Z-shape configuration, shown in FIG. 2. Webs 21 and 21*a* are interconnected face-to-face in any normal manner as by spot welding, and lips 26*a* and 29*a* of member 20A respectively confront lips 29 and 26 of member 20. The outwardly extending abutment walls 27 and 27*a* of the combined member therefore define together with the webs a substantially Z-shape, confronting lips 29, 26*a* defining a groove 31 therebetween, and the confronting lips 26, 29*a* defining a groove 32 therebetween. Each groove and the confronting lips thereby defined is capable of snugly receiving a sealing member in the form of an elastomeric strip 33 shown in FIG. 9 and to be more fully described hereinafter.

A frame profile 20B, of identical size and shape as that of profile member 20, is combinable therewith as by spot welding, or pierce riveting, webs 21, 21*b* together to form a substantially T-shaped configuration of FIG. 3. Here, lips 29 and 26 of member 20 respectively confront lips of 29*b* and 26*b* of member 20B, the confronting pairs respectively defining grooves 34, 35 therebetween likewise for the reception in sealing members 33.

Figure 4:
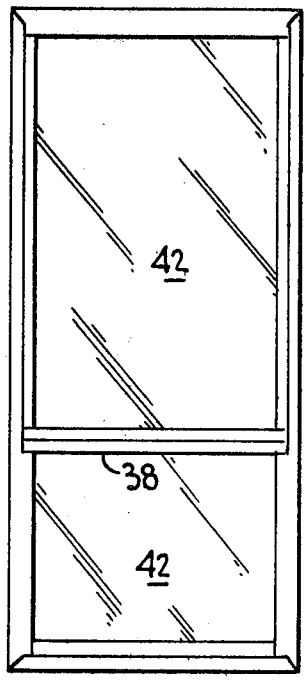
FIG. 4 is a plan view, at a reduced scale, of a window unit assembled of frame members formed according to the invention.
Figure 5:
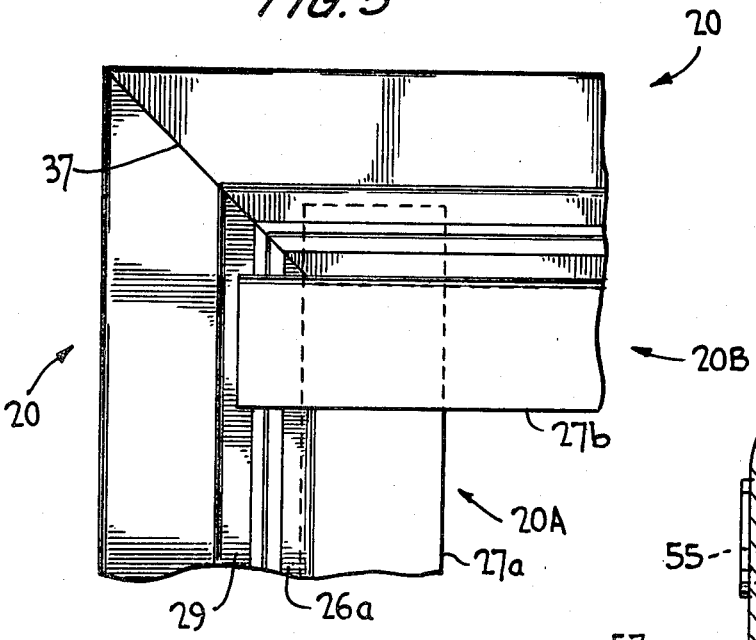
FIG. 5 is a plan view of a typical corner joint between frame members according to the invention.

In practice of the invention, a window or door unit, such as that shown at 36 in FIG. 4, is assembled of frame members the L-, Z- and/or T-shaped frame members or FIGS. 1 to 3 by forming mitered joints 37 at the corners (FIG. 5) and welding them together. A pair of members of Z- and T-shaped configuration are shown in the FIG. 5 corner joint with abutment wall 27*b* unmitered and overlapping lips 29 and 26*a*, and abutment wall 27*a* being unmitered and underlying confronting flanges 29, 29*b* (hidden in this figure). Otherwise, walls 27*a* and 27*b* may likewise be mitered along line 37 of the corner joint, without departing from the invention.

Figure 6:
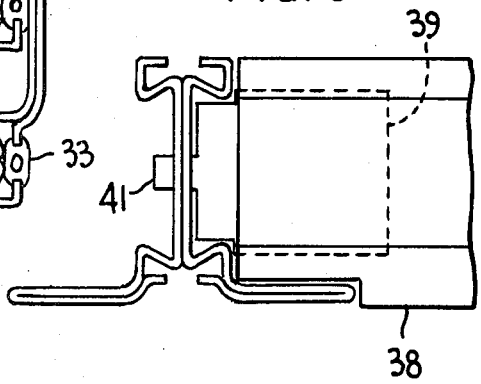
FIG. 6 is a cross-sectional view, at a reduced scale, of the joint between a muntin bar and a frame member of T-shape configuration.

One of the T-shapes is shown in FIGS. 4 and 6 as forming a muntin bar 38 joined to the side frame members of the window construction by means of a plate 39 welded or otherwise secured to the bar and lying within a dovetail channel opening. This plate 39 has a tongue 41 inserted through a suitable opening provided in each side frame member and thereafter bent or upset to hold the parts together. One of the interfering abutment walls between the two members in FIG. 6 may be partially removed to accommodate the other.

A glass or plastic window pane 42 may be installed in an assembled frame unit and securely held in place by window molding members 43, shown in detail in FIG. 7. Each molding member may be of plastic construction and comprises a pair of joined leg members 44, 45 having an outwardly extending lug 46 received within the groove of a compressible sealing member 47. Inner leg 45 is bent to form portion 48 lying parallel to web 21, and flanges 49 and 51 extend from portion 48 and leg 44 into abutting engagement with flanges 23 and 22 for securely maintaining the molding in place. A shoulder 52 may be provided on leg 44 for stabilizing the molding member in place by engaging the outer surface of wall portion 24. Resilient sealing tape segments 53, or the like, may be disposed between abutment wall 27 and the outer surface of window pane 42.

In FIG. 8, sealing member 47 is eliminated and lugs 46*a* is extended to bear directly against the inner surface of the window pane. And, it should be pointed out that, while a frame member 20 is shown in FIGS. 7 and 8 for supporting the window pane, the Z- or T-shaped frame members are similarly used with molding members 43 in the window pane construction, or any combination of the three shapes are used depending on the specific frame construction intended.

Figure 9:
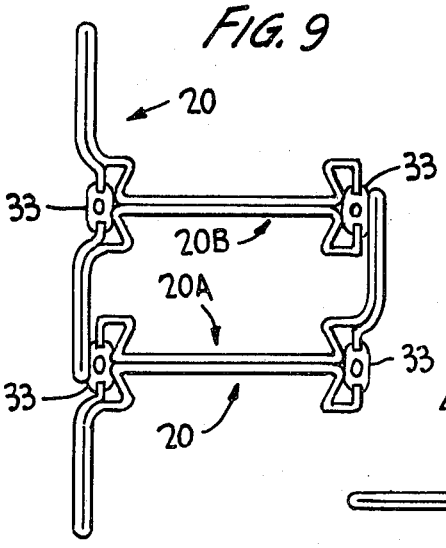
FIG. 9 is a sectional view, at a reduced scale, of an upper fixed window frame member of T-shape and a lower vented window frame member of Z-shape.

In the FIG. 9 example, the lower crosswise member of an upper fixed window is of T-shape, while the upper crosswise member of a lower vented window is of Z-shape, the vented window being pivoted to open about a lower hinge to the right when viewing this figure Seal strips 33 have opposed grooves for the reception of the confronting lips of the frame members, and have bulging outer sides for contact in the bottom of the groove in which they are disposed, and for providing a thermal barrier upon contact with the abutment wall of an adjacent window member as shown. Seal strips 33 may thus act as a combined weather strip and heat insulator.

Figure 10:
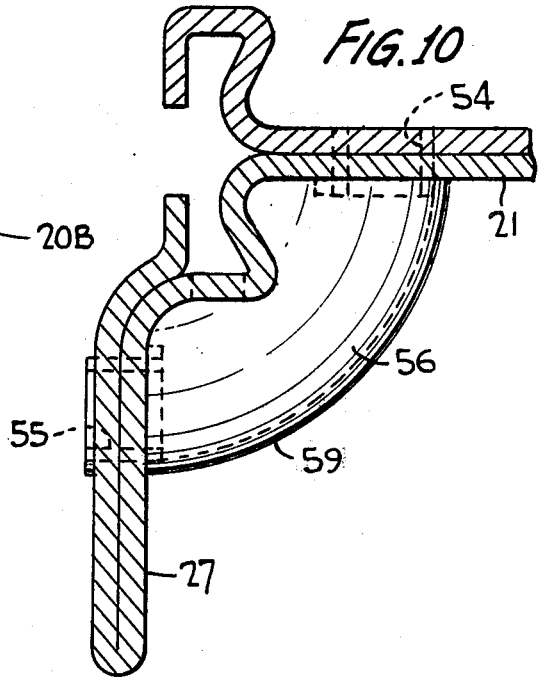
FIG. 10 is a sectional view of a Z-shaped frame member with a weep hole insert mounted thereon.
Figure 11:
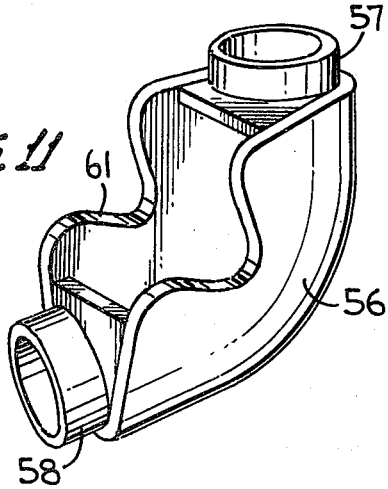
FIG. 11 is a perspective view of the FIG. 10 insert.

Another feature of the invention includes the provision of weep holes 54, 55 provided in the interconnected web portions of, for example, Z-section as well as in one of the abutment walls, as shown in FIG. 10. A weep hole insert 56, of non-metallic construction, is shown mounted on the frame member as collars 57, 58 (FIG. 11) thereof extend respectively into weep holes 54 and 55. The inner surface of curved wall 59 of the insert defines an open channel between the two collars for directing rain water and condensation from the window unit to the outside. The inner corner of the insert is contoured as at 61 to the shape of the confronting inner surface of the window frame. Also, the weep holes and the insert function as a breather to eliminate interior water leakage due to variations in wind pressure.

From the foregoing, it can be seen that a simple and economical yet highly effective window frame section, preferably of cold-rolled steel, has a basic L-shaped configuration which can be used alone in the assembly of a window or door frame, and which present an open dovetail channel for the reception of a glass molding member of plastic or non-metallic construction. The L-shaped section is combinable with other like sections to form window frame members of Z-shape or T-shape configurations. The frame members may be coated with a baked polyester resin, so that together with the sealing strips, compressible seals, resilient sealing tape, and non-metallic molding members a construction of reduced heat transmission is provided.

Obviously, many other modifications and variations of the present invention are made possible in the light of the above teachings. It is therefore to be understood that within the scope of the appended claims the invention may be practiced otherwise than as specifically described.

What is claimed is:

1. A frame section for a window frame or door frame structure, comprising a first roll-formed frame member of substantially L-shape in cross-section having a flat web portion, first and second flanges respectively at opposite ends of said web extending from one side thereof and converging toward one another at acute angles to the plane of said web, said flanges defining an open dovetail shape channel capable of receiving a glass molding means, a first end wall portion extending outwardly of the free end of said first flange and lying parallel to said web portion in spaced relation, a first lip extending from the free end of said first end wall portion toward and substantially perpendicular to said web portion and terminating in spaced relation from an opposite side thereof, a second end wall portion extending outwardly of the free end of said second flange and lying parallel to said web portion in spaced relation, a first abutment wall capable of supporting one side of a window pane and extending from the free end of said second end wall portion away from and substantially perpendicular to said web portion, a second lip extending from said abutment wall toward and substantially perpendicular to said web portion and terminating in spaced relation from said opposite side thereof, a second roll-formed frame member of substantially L-shape in cross-section having a flat web portion interconnected with said web portion of said first frame member and forming together with said first member a body of substantially T-shape in cross-section, third and fourth flanges respectively at opposite ends of said web of said second frame member extending from one side thereof and converging toward one another at acute angles to the plane of said another member web, said third and fourth flanges lying respectively opposite said first and second flanges and defining a dovetail shape channel capable of receiving a glass molding means, a third end wall portion extending outwardly of the free end of said third flange and lying parallel to said web portion of said second member in spaced relation, a third lip extending from the free end of said third end wall portion toward and substantially perpendicular to said web portion of said second member and terminating in spaced relation from an opposite side thereof, said first and third lips extending toward one another and having terminal ends spaced apart for defining a first groove therebetween, a first elastomeric sealing member disposed in said groove and extending outwardly of outer sides of said first and third lips and abutting against said first and third flanges to thereby define a combined weather strip and thermal strip, said first sealing member engaging said terminal ends of said first and third lips so as to be thereby retained in said first groove, a fourth end wall portion extending outwardly of the free end of said fourth flange and lying parallel to said web portion of said another member in spaced relation, a second abutment wall capable of supporting one side of a window pane and extending from the free end of said fourth end wall portion away from and substantially perpendicular to said web portion of said second member, and a fourth lip extending from said second abutment wall toward and substantially perpendicular to said web portion of said second member and terminating in spaced relation from said opposite side thereof, said second and fourth lips extending toward one another and having terminal ends spaced apart for defining a second groove, a second elastomeric sealing member disposed in said second groove and abutting against said second and fourth flanges to thereby define a thermal strip, said second sealing member engaging said terminal ends of said second and fourth flanges so as to be thereby retained in said second groove.

2. The frame section according to claim 1, wherein said interconnected web portion and one of said abutment walls are provided with drainage weep holes, an insert mounted on said body and defining a channel extending between said holes, said insert having collars at open ends lying perpendicular to one another and respectively projecting into said holes for mounting said insert in place.

3. A frame section for a window frame or door frame structure, comprising a first roll-formed frame member of substantially L-shape in cross-section having a flat web portion, first and second flanges respectively at opposite ends of said web extending from one side thereof and converging toward one another at acute angles to the plane of said web, said flanges defining an open dovetail shape channel capable of receiving a glass molding means, a first end wall portion extending outwardly of the free end of said first flange and lying parallel to said web portion in spaced relation, a first lip extending from the free end of said first end wall portion toward and substantially perpendicular to said web portion and terminating in spaced relation from an opposite side thereof, a second end wall portion extending outwardly of the free end of the said second flange and lying parallel to said web portion in spaced relation, a first abutment wall capable of supporting one side of a window pane and extending from the free end of said second end wall portion away from and substantially perpendicular to said web portion, a second lip extending from said abutment wall toward and substantially perpendicular to said web portion and terminating in spaced relation from said opposite side thereof, a second roll-formed frame member of substantially L-shape in cross-section having a flat web portion interconnected with said web portion of said first frame member and forming together with said one member a body of substantially Z-shape in cross-section, third and fourth flanges respectively at opposite ends of said web of said second frame member extending from one side thereof and converging toward one another at acute angles to the plane of said second member web, said third and fourth flanges lying respectively opposite said second and first flanges and defining a dovetail shape channel capable of receiving a glass molding means, a third end wall portion extending outwardly of the free end of said third flange and lying parallel to said web portion of said second member in spaced relation, a third lip extending from the free end of said third end wall portion toward and substantially perpendicular to said web portion of said second member and terminating in spaced relation from an opposite side thereof, a fourth end wall portion extending outwardly of the free end of said fourth flange and lying parallel to said web portion of said second member in spaced relation, a second abutment wall capable of supporting one side of a window pane and extending from the free end of said fourth end wall portion away from and substantially perpendicular to said web portion of said second member, a fourth lip extending from said second abutment wall toward and substantially perpendicular to said web portion of said second member and terminating in spaced relation from said opposite side thereof, said first and fourth lips extending toward one another and having terminal ends spaced apart for defining a first groove therebetween, a first elastomeric sealing member disposed in said groove and extending outwardly of outer sides of said first and fourth lips and abutting against said first and fourth flanges to thereby define a combined weather strip and thermal strip, said first sealing member engaging said terminal ends of said first and fourth lips so as to be thereby retained in said first groove, and said second and third lips extending toward one another and having terminal ends spaced apart for defining a groove therebetween, a second elastomeric sealing member disposed in said second groove and extending outwardly of outer sides of said second and third lips and abutting against said second and third flanges to thereby define a combined weather strip and thermal strip, said second sealing member engaging said terminal ends of said second and third lips so as to be thereby retained in said second groove.

4. The frame section accordinng to claim 3, wherein said interconnected web portions and one of said abutment walls are provided with drainage weep holes, an insert mounted on said body and defining a channel extending between said holes, said insert having collars at open ends lying perpendicular to one another and respectively projecting into said holes for mounting said insert in place.

* * * * *